US007150664B1

(12) United States Patent
Uppgard et al.

(10) Patent No.: US 7,150,664 B1
(45) Date of Patent: Dec. 19, 2006

(54) STEERING ACTUATOR FOR AN OUTBOARD MOTOR

(75) Inventors: Darin C. Uppgard, Oshkosh, WI (US); Randall J. Poirier, Howards Grove, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/296,984

(22) Filed: Dec. 8, 2005

(51) Int. Cl.
*B63H 20/08* (2006.01)
*B63H 20/12* (2006.01)
*B63H 5/125* (2006.01)

(52) U.S. Cl. ..... 440/53; 440/61 S; 440/61 C

(58) Field of Classification Search ..... 440/61 R, 440/61 S, 53–60, 61, 62–65; 114/144 R, 114/150
See application file for complete search history.

(56) References Cited

U.S. PATENT DOCUMENTS 4,773,882 A * 9/1988 Rump ..... 440/61 R
5,092,801 A * 3/1992 McBeth ..... 440/61 R
5,213,527 A 5/1993 Fetchko ..... 440/61
5,241,894 A 9/1993 Hundertmark ..... 91/417 R
5,427,045 A 6/1995 Fetchko ..... 114/150
5,471,907 A 12/1995 Kobelt ..... 91/368
5,542,864 A 8/1996 Peebles ..... 440/61
5,658,177 A 8/1997 Wagner ..... 440/61
5,997,370 A * 12/1999 Fetchko et al. ..... 440/61 R
6,276,977 B1 8/2001 Treinen et al. ..... 440/61
6,390,867 B1 * 5/2002 Nakamura et al. ..... 440/61 R
6,402,577 B1 6/2002 Treinen et al. ..... 440/61
6,761,599 B1 7/2004 Ferguson ..... 440/61 S

FOREIGN PATENT DOCUMENTS

JP 06040382 A * 2/1994
JP 2005289300 A * 10/2005

* cited by examiner

*Primary Examiner*—Ajay Vasudeva
(74) *Attorney, Agent, or Firm*—William D. Lanyi

(57) ABSTRACT

A steering actuator system for an outboard motor connects an actuator member to guide rails which are, in turn, attached to a motive member such as a hydraulic cylinder. The hydraulic cylinder moves along a first axis with the guide rail extending in a direction perpendicular to the first axis. An actuator member is movable along the guide rail in a direction parallel to a second axis and perpendicular to the first axis. The actuator member is attached to a steering arm of the outboard motor.

20 Claims, 9 Drawing Sheets

STEERING ACTUATOR FOR AN OUTBOARD MOTOR

BACKGROUND OF THE INVENTION

1. Field of the Invention

The present invention is generally related to steering actuators and, more particularly, to a steering actuator which uses hydraulic pressure to move a motive member along a reciprocal path and an actuator member which is movable in a direction generally perpendicular to the reciprocal path.

2. Description of the Related Art

Those skilled in the art of steering systems for outboard motors are familiar with many different types of actuators that are used to convert hydraulic pressure to rotation of an outboard motor about its steering axis.

U.S. Pat. No. 4,773,882, which issued to Rump on Sep. 27, 1988, describes a hydraulic steering assembly for outboard engines. The assembly is secured to a tiller arm of a variety of outboard propulsion units in order to rotate a propulsion unit about its steering axis. The assembly comprises a hydraulic cylinder having a hydraulically actuated rod member extending therefrom and being rotatably secured to the tiller arm of an outboard propulsion unit about an axis of rotation parallel to the steering axis.

U.S. Pat. No. 5,542,864, which issued to Peebles on Aug. 6, 1996, describes a steering cylinder for an outboard engine. The hydraulic cylinder has an elongate interior chamber, a piston movable in the chamber, and a first fluid passage generally parallel to the chamber. In the improvement, the cylinder includes a second fluid passage generally parallel to the chamber and both passages terminate at faces at either end of the cylinder housing.

U.S. Pat. No. 5,092,801, which issued to McBeth on Mar. 3, 1992, describes a hydraulic steering assembly for outboard marine engines. The assembly is connected to the tiller arm of an outboard marine engine and includes a piston rod supported for arcuate movement about the tilt axis while remaining parallel thereto. A hydraulic cylinder travels along the piston rod. An arm extends from the cylinder to a first pivotal member establishing a first pivotal connection about an axis parallel to the tilt axis. A rigid link extends between the first pivotal member and a second pivotal member. The second pivotal member is also connected to the tiller arm and establishes a second pivotal connection about an axis perpendicular to the tilt axis.

U.S. Pat. No. 5,213,527, which issued to Fetchko on Mar. 25, 1993, describes a marine power steering actuator system. An actuator assembly is provided for a powered steering ram of a marine inboard/outboard drive of the type where the ram is connected to a tiller arm and has a spool valve mounted on the ram. The spool valve has a fastening tube which opens the spool valve when displaced in either direction to supply hydraulic fluid to the ram to move the tiller arm in the direction the fastening tube is displaced.

U.S. Pat. No. 5,241,894, which issued to Hundertmark on Sep. 7, 1993, discloses a marine power steering system. The system is for operation of a power steering assembly and includes a pressure accumulator to provide pressurized hydraulic fluid and valving that permits the transfer of hydraulic fluid within the cylinder to provide efficient use of hydraulic fluid.

U.S. Pat. No. 5,427,045, which issued to Fetchko on Jun. 27, 1995, describes a steering cylinder with integral servo and valve. The steering actuator is operatively connected to the tiller of the craft. A hydraulic servo actuator is mounted on the steering actuator. The servo actuator is permitted limited axial displacement relative to the steering actuator. The servo actuator is operatively connected to the steering actuator. A servo valve is mounted on the actuator assembly and has ports for receiving pressurized hydraulic fluid.

U.S. Pat. No. 5,471,907, which issued to Kobelt on Dec. 5, 1995, describes a marine steering apparatus. A fluid power apparatus is connected to a pressurized fluid supply and a conventional helm pump controlled by the helm of a vessel to shift the rudder. The apparatus comprises an actuator cylinder connected to the rudder, and a servo cylinder and a main valve connected to the helm pump to pass fluid therebetween and between the actuator cylinder. The actuator cylinder and servo cylinder have respective bodies and piston rods, and portions of the servo cylinder and actuator cylinder are connected together for concurrent simultaneous movement along respective longitudinal axes.

U.S. Pat. No. 5,658,177, which issued to Wagner on Aug. 19, 1997, describes a mounting arrangement for an engine steering cylinder. The mounting bracket is used to couple a hydraulic steering cylinder to one of first and second brands of outboard engines. Such bracket has first and second groups of holes, the holes comprising each group positionally corresponding to a bracket attachment hole in the first or second brand of engine.

U.S. Pat. No. 5,997,370, which issued to Fetchko et al. on Dec. 7, 1999, describes an outboard hydraulic steering assembly with reduced support bracket rotation. A hydraulic steering assembly applies a force to a tiller arm of a marine outboard propulsion unit and rotates the propulsion unit about a steering axis between a center position and hard over positions to each side of the center position. The propulsion unit is supported for arcuate movement about a tilt axis which is generally perpendicular to the steering axis. The steering assembly includes a hydraulic steering cylinder with an elongated piston rod reciprocatingly mounted within the cylinder for movement along a piston rod axis. A pair of support arms are pivotable about the tilt axis and are connected to the piston rod, allowing arcuate movement of the rod about the tilt axis, while maintaining the rod axis parallel to the tilt axis.

U.S. Pat. No. 6,276,977, which issued to Treinen et al. on Aug. 21, 2001, discloses an integrated hydraulic steering actuator. The actuator is provided for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of an outboard motor. The one or more rods attached to the piston are aligned coaxially with an axis of rotation about which the swivel bracket rotates when the outboard motor is trimmed. As a result, no relative movement occurs between the outboard motor, the rod attached to the piston of the actuator, and the swivel bracket during rotation of the outboard motor about the axis of rotation.

U.S. Pat. No. 6,402,577, which issued to Treinen et al. on Jun. 11, 2002, discloses an integrated hydraulic steering system for a marine propulsion unit. The system is provided in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a movable second portion of the steering actuator. The movable second portion of the steering actuator moves linearly within a cylinder cavity formed in a first portion of the steering actuator.

U.S. Pat. No. 6,761,599, which issued to Ferguson on Jul. 13, 2004, describes a marine steering system having a swivel bracket forming hydraulic cylinder. The apparatus for a marine craft has a first bracket connectable to the stern of the marine craft. There is a second bracket connectable to the propulsion unit of the marine craft. The second bracket is rotatably connected to the first bracket for relative rotation about an axis of rotation. The propulsion unit can be rotated about the axis of rotation relative to the stern of the craft. The second bracket has a cylindrical bore extending therethrough. A piston is reciprocatingly received within the bore. The piston slidingly engages the bore and has a piston rod connected thereto. The piston rod is operatively connected to the propulsion unit.

The patents described above are hereby expressly incorporated by reference in the description of the present invention.

SUMMARY OF THE INVENTION

A steering actuation system for a marine propulsion system, made in accordance with a preferred embodiment of the present invention, comprises a motive member which is movable along a first axis and a guide rail structure attached to the motive member and extending from the motive member in a direction which is generally parallel to a second axis. It also comprises an actuator member slidably attached to the guide rail structure for movement relative to the motive member in a direction parallel to the second axis and movement with the motive member parallel to the first axis. The actuator is attachable to a steering arm of the marine propulsion system which is rotatable about a steering axis.

The steering actuation system in a preferred embodiment of the present invention can further comprise a piston rod having a central axis which is coaxial with the first axis. The motive member is a cylinder which is slidably associated with a piston rod. It also can comprise a piston attached to the piston rod and disposed within the cylinder. The cylinder can be a hydraulic cylinder. The piston rod can have a conduit formed therein to direct hydraulic fluid into a cavity of the hydraulic cylinder. A connecting link can be attached to the actuator member and can be attachable to the steering arm of the marine propulsion system.

The first axis can be defined by a stationary portion of the marine propulsion system which is attachable to a marine vessel and, more specifically, to a transom of the marine vessel. The steering arm can be attached to a rotatable portion of the marine propulsion system, such as an outboard motor. The guide rail structure can comprise two rods. The two rods extend in a direction which is generally perpendicular to the first axis and generally parallel to the second axis. The two rods, in a preferred embodiment of the present invention, are shaped to be received in sliding association within two associated holes formed in the actuator member.

BRIEF DESCRIPTION OF THE DRAWINGS

The present invention will be more fully and completely understood from a reading of the description of the preferred embodiment of the present invention, in conjunction with the drawings, in which.

DESCRIPTION OF THE PREFERRED EMBODIMENT

Figures 1, 2:
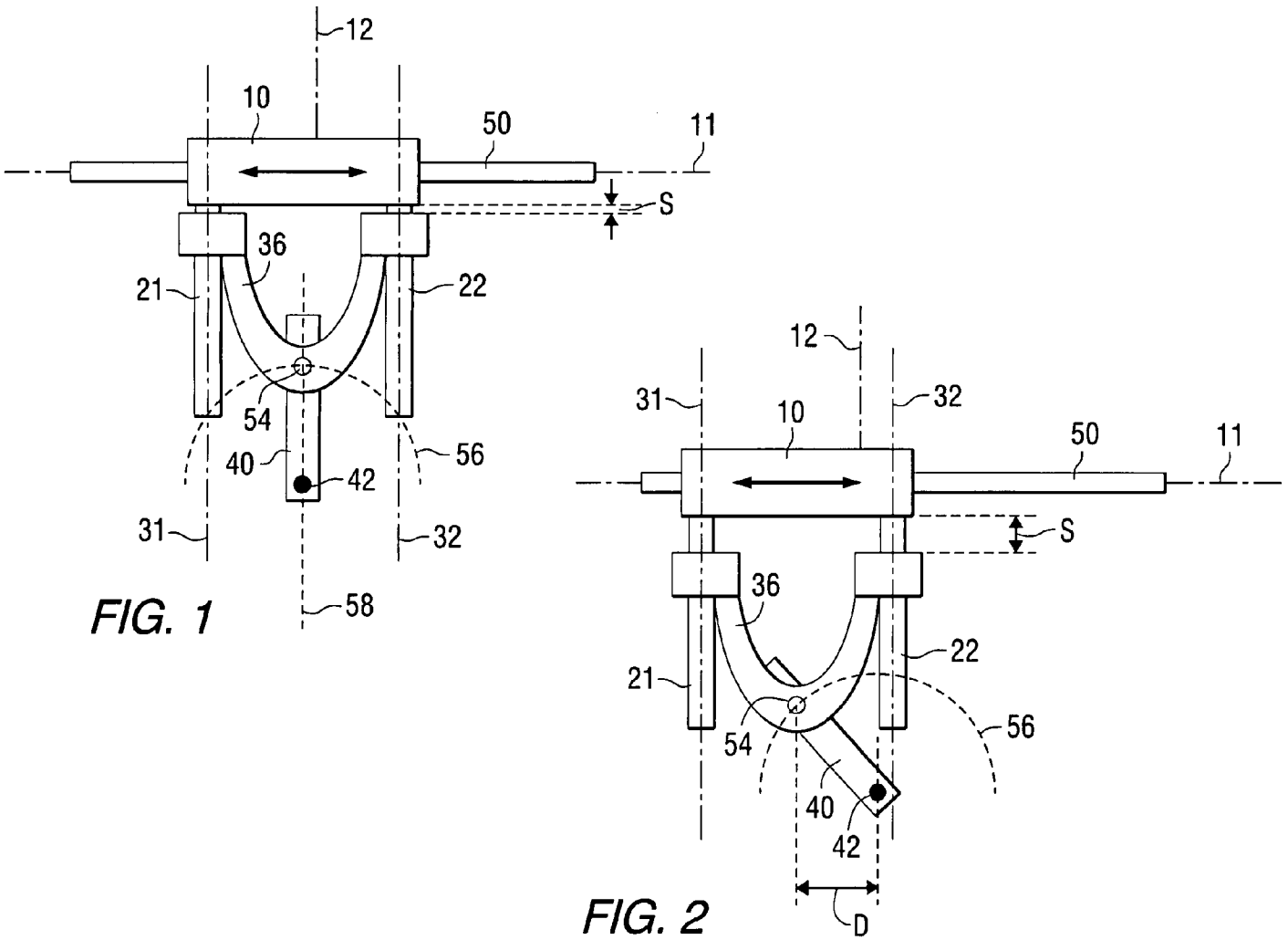
FIGS. 1 and 2 are simplified schematic representations of the present invention.

Throughout the description of the preferred embodiment of the present invention, like components will be identified by like reference numerals.

FIGS. 1 and 2 are simplified schematic representations which are provided to show the basic components of the present invention and the way in which they cooperate with each other. More detailed and specific illustrations are provided in FIGS. 3–11 and will be discussed in greater detail below.

With reference to FIG. 1, a steering actuation system for a marine propulsion system made in accordance with a preferred embodiment of the present invention comprises a motive member 10 which is movable along a first axis 11. A guide rail structure, comprising two rods, 21 and 22, is attached to the motive member 10 and extends from the motive member in a direction which is generally parallel to a second axis 12. The first and second rods, 21 and 22, of the guide rail structure have centerlines, 31 and 32, as shown in FIG. 1. An actuator member 36 is slidably attached to the guide rail structure for movement relative to the motive member 10 in a direction which is generally parallel to the second axis 12 and for movement with the motive member 10 parallel to the first axis 11. The actuator member is attachable to a steering arm 40, or tiller arm, of the marine propulsion system which is rotatable about a steering axis 42.

With continued reference to FIG. 1, a piston rod 50 having a central axis which is coaxial with the first axis 11 is also provided in a preferred embodiment of the present invention. The motive member 10 is a hydraulic cylinder which is slidably associated with the piston rod 50. A piston (not shown in FIG. 1) is attached to the piston rod 50 and disposed within the cylinder of the motive member 10.

FIG. 2 is generally similar to FIG. 1, but with the motive member 10 moved toward the left relative to its position in FIG. 1. In comparison to the condition represented in FIG. 1, FIG. 2 shows the changes that take place when the steering arm 40 is rotated about the steering axis 42 as shown. Dimension S in FIG. 1 is relatively small and can be virtually non-existent when the steering arm 40 is in its central position. That same dimension S in FIG. 2 is significantly increased and represents a movement of the actuator member 36 away from the motive member 10. This movement of the actuator member 36 results from the connection between the actuator member 36 and the steering arm 40 at point 54. Dashed arcuate line 56 represents the path traveled by the connection point 54 which is common to both the actuator member 36 and the steering arm 40.

In FIG. 1, dashed line 58 represents a position of both the steering axis 42 and the connection point 54. In FIG. 2, dimension D illustrates the distance, parallel to the first axis 11, between the steering axis 42 and the connection point 54 when the motive member 10 is moved toward the left as shown. The condition represented in FIG. 1 would exist when a marine vessel is being steered straight ahead. The condition represented in FIG. 2 would exist when the marine vessel is being turned toward starboard. In a preferred embodiment of the present invention, the piston rod 50 is rigidly attached to a transom of the marine vessel and the steering axis 42 is a vertical axis located behind the transom of the marine vessel. The steering axis 42 represents the axis about which the outboard motor rotates during steering maneuvers.

Figure 3:
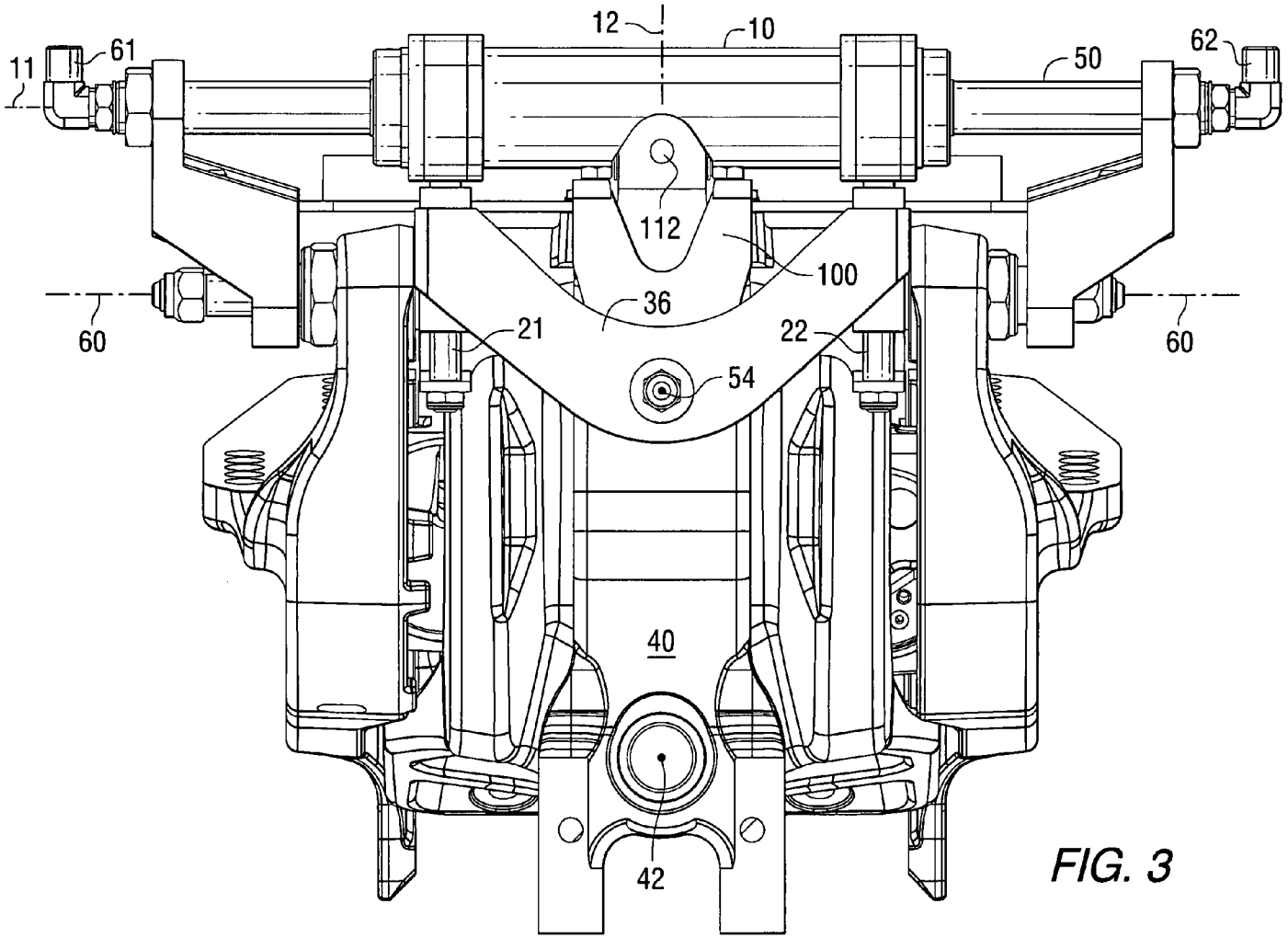
FIG. 3 is a detailed illustration of a preferred embodiment of the present invention.

FIG. 3 shows a more detailed illustration of a preferred embodiment of the present invention. The motive member 10 is shown slidably supported on the piston rod 50 for reciprocal movement parallel to the first axis 11. The guide rail structure is shown as first and second rods, 21 and 22, which guide the movement of the actuator member 36, relative to the motive member 10, in a direction parallel to the second axis 12. The first and second rods, 21 and 22, are shaped to be received in sliding association within holes (not shown in FIG. 3) formed in the actuator member 36. The steering arm 40 is shown attached between the steering axis 42 and the connection point 54, as described above in conjunction with FIGS. 1 and 2. For purposes of reference, the tilt axis 60 of the outboard motor is illustrated in FIG. 3. In addition, first and second hydraulic ports, 61 and 62, are shown. In a particularly preferred embodiment of the present invention, the piston rod 50 has a conduit formed within its structure to conduct hydraulic fluid to and from cavities within the hydraulic cylinder which is the motive member 10.

Figure 4:
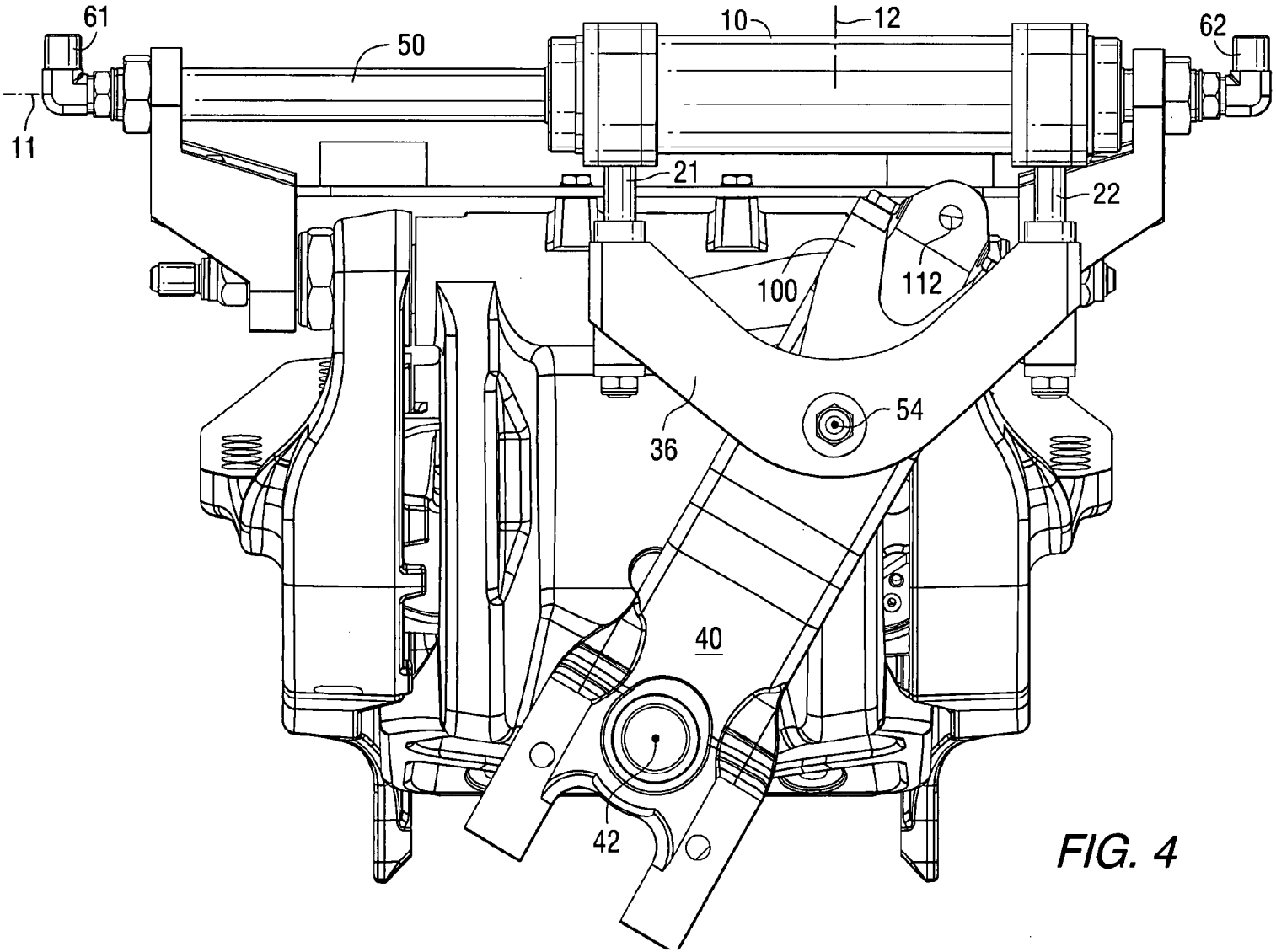
FIG. 4 is generally similar to FIG. 3, but showing a movement which results in a turn toward port of the marine vessel.

FIG. 4 is generally similar to FIG. 3, but shows the motive member 10 moved toward the right in a direction generally parallel to the first axis 11. The steering arm 40 is rotated in a clockwise direction about the steering axis 42. In order to effect this movement of the steering arm 40, the motive member 10 moves to the right in a direction parallel to the first axis 11. The actuator member 36 moves, in a coordinated manner, with the motive member 10 in a direction parallel to the first axis 11 and relative to the motive member 10 in a direction parallel to the second axis 12. As can be seen in FIG. 4, the actuator member 36 is displaced from the motive member 10 by a greater distance than in FIG. 3. This is accommodated by the actuator member 36 sliding on the rails, 21 and 22. The condition shown in FIG. 4 would result in the marine vessel turning towards port.

With continued reference to FIGS. 1, 2, and 4, it can be seen that the connecting point 54 between the actuator member 36 and the steering arm 40 moves along an arcuate path 56 which has its center at the steering axis 42. This arcuate path of the connecting point 54 is accommodated by the movement of the actuator member 36 in dual directions which include movement in a direction parallel to the first axis 11 and movement, relative to the motive member 10, in a direction parallel to the second axis 12.

Figure 5:
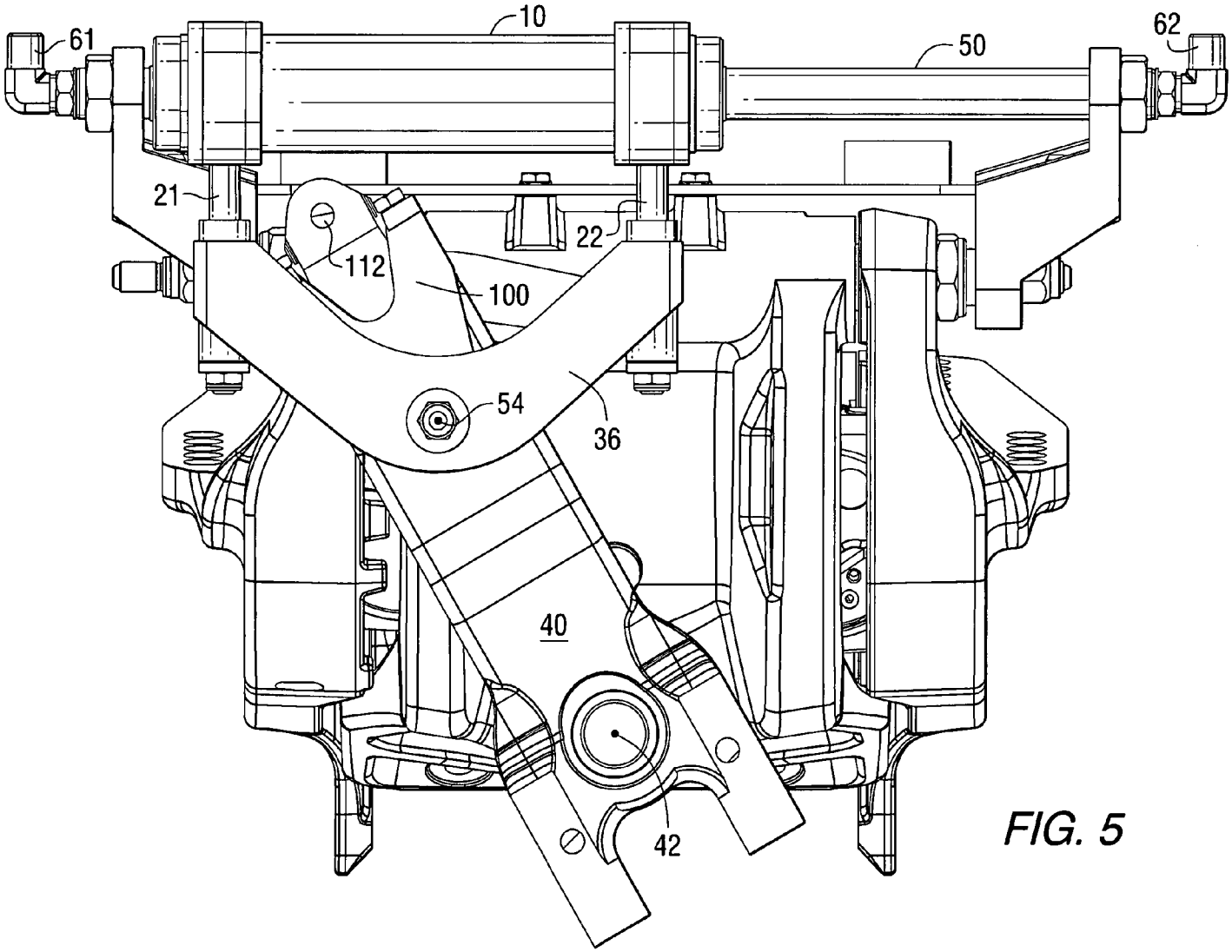
FIG. 5 is generally similar to FIGS. 3 and 4, but configured to show the movement of components which result in a turn toward starboard of the marine vessel.

FIG. 5 shows the present invention during a turn toward starboard of the marine vessel. FIG. 5 is generally similar to FIG. 4, but with the motive member 10 moved toward the left relative to the steering axis 42 in order to effect a turn toward starboard.

Figure 6:
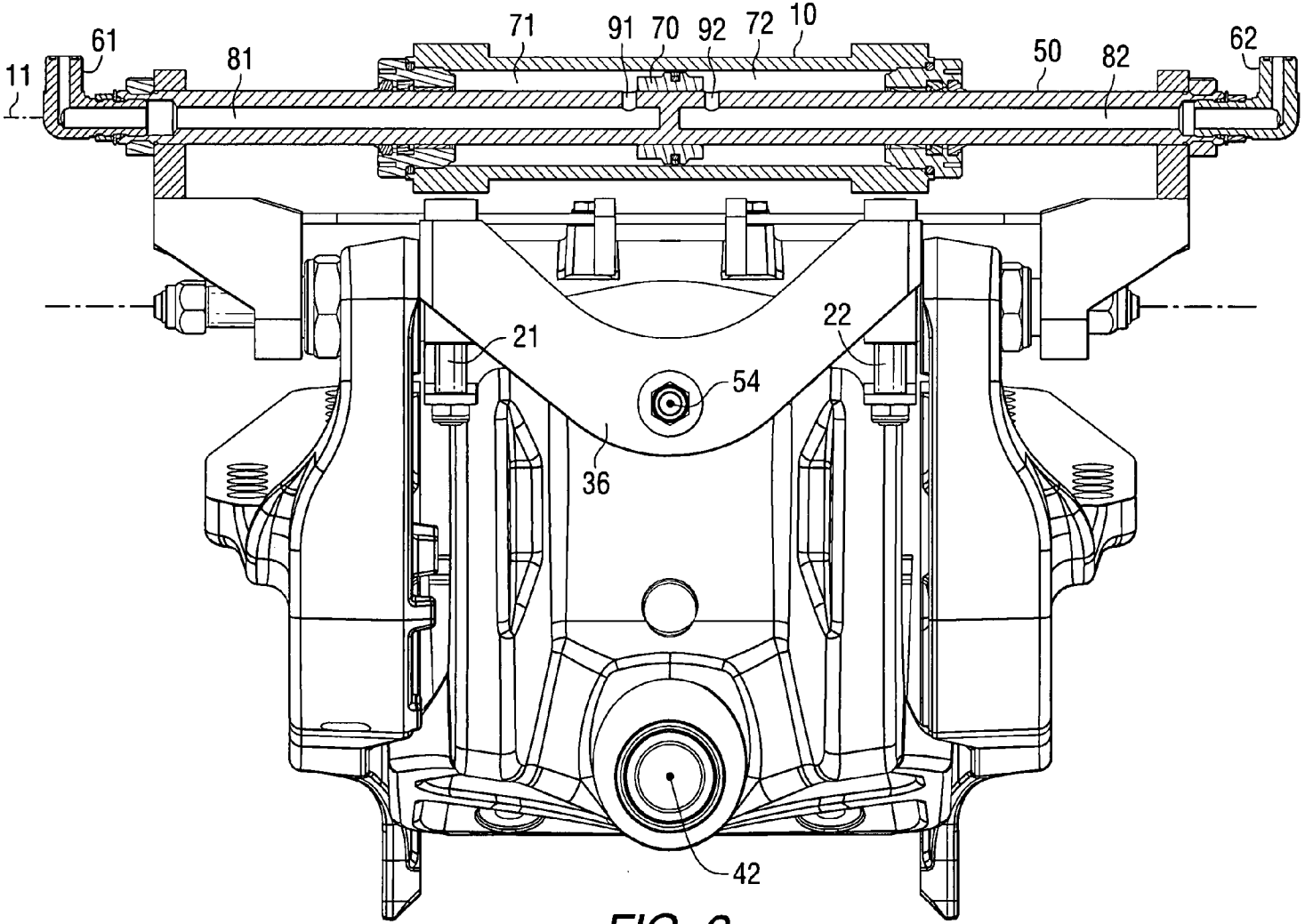
FIG. 6 is a partially sectioned view of a preferred embodiment of the present invention showing internal conduits for the flow of hydraulic fluid.

FIG. 6 illustrates another feature of a preferred embodiment of the present invention. In order to illustrate that feature, a section view is provided through a plane which exposes the internal portions of the motive member 10, the piston rod 50, and the first and second hydraulic ports, 61 and 62.

With continued reference to FIG. 6, the motive member 10 is a hydraulic cylinder having a cavity formed therein. A piston 70 is attached to the piston rod 50 and its position within the cavity of the hydraulic cylinder 10 determines the relative size of a first cavity 71 and a second cavity 72. The piston rod 50 has a pair of conduits, 81 and 82, formed within its structure. Hydraulic fluid can be introduced through hydraulic port 61, through conduit 81 and through opening 91 into the cavity 71 on the left side of the piston 70 within the hydraulic cylinder of the motive member 10. Conversely, hydraulic fluid can be introduced into the hydraulic port 62, through the second conduit 82, and through the second opening 92 into the second portion 72 of the cavity within the motive member 10. By introducing hydraulic fluid into one of the two hydraulic ports, 61 or 62, and removing hydraulic fluid from the other port, 61 or 62, hydraulic pressure within a selected portion, 71 or 72, of the cavity within the motive member 10, can be used to force the motive member 10 toward the left or right in a direction parallel to the first axis 11. This selective pressurization of one of the two cavities, 71 or 72, causes the motive member to move, with its attached guide rail structure comprising first and second rods, 21 and 22. As a result, rotation of the steering arm 40, as described above in conjunction with FIGS. 1–4, about the steering axis 42 is achieved.

Figure 7:
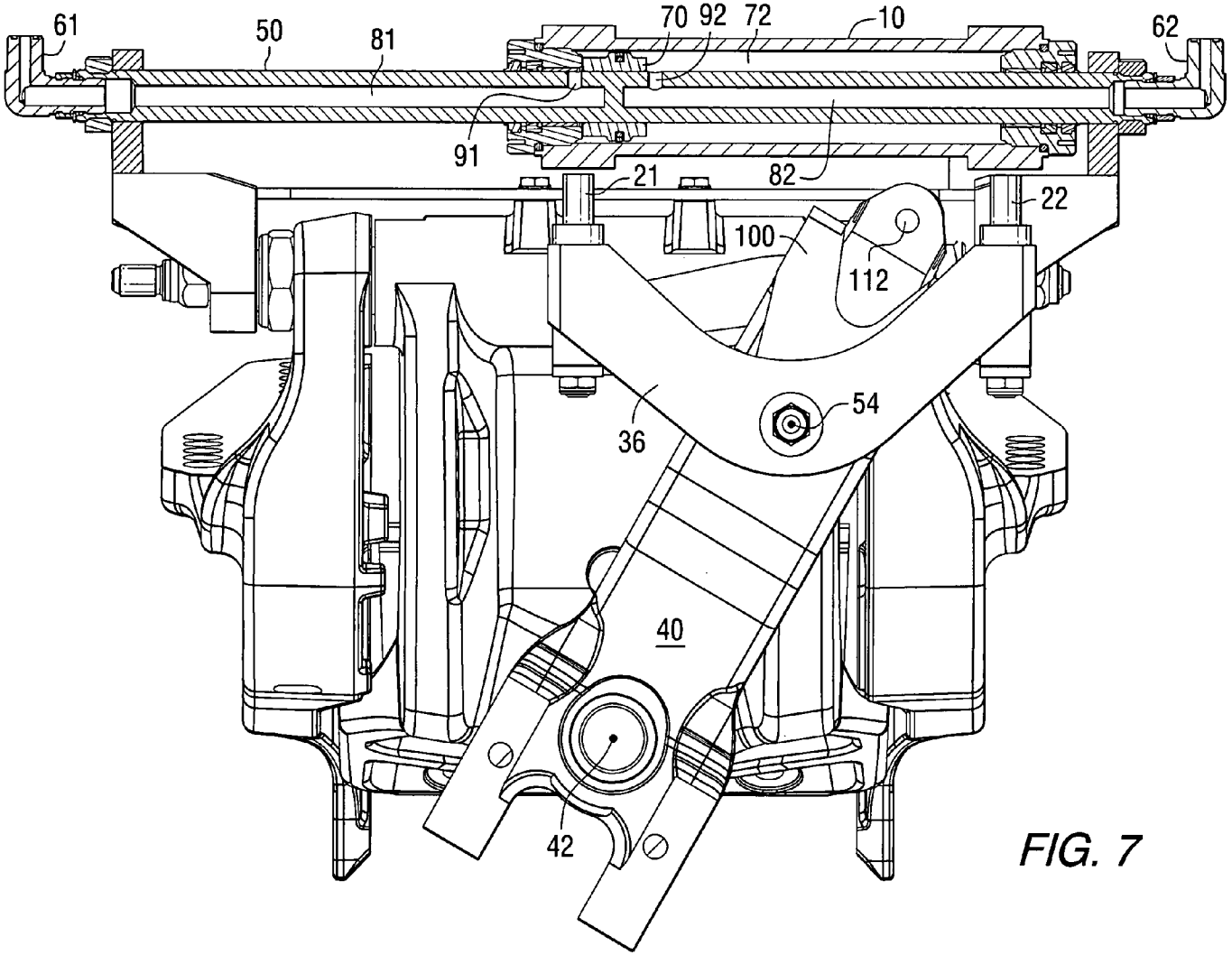
FIG. 7 is generally similar to FIG. 6 but with the components configured to show a turn toward port.

FIG. 7 is generally similar to FIG. 6, but with the motive member 10, or hydraulic cylinder, moved toward the right. This is achieved by introducing pressurized hydraulic fluid into the second hydraulic port 62, the second portion 82 of the conduit within the piston rod 50, through the second opening 92, and into the second portion 72 of the cavity within the motive member 10. The increased pressure in cavity 72 causes the hydraulic cylinder of the motive member 10 to move toward the right. As described above, this moves the actuator member 36 toward the right and rotates the steering arm 40 in a clockwise direction about the steering axis 42. It should be understood that a symmetrical motion toward the left can be achieved by introducing pressure into the first hydraulic port 61 and allowing hydraulic fluid to pass through the second hydraulic port 62 away from conduit 82.

Figure 8:
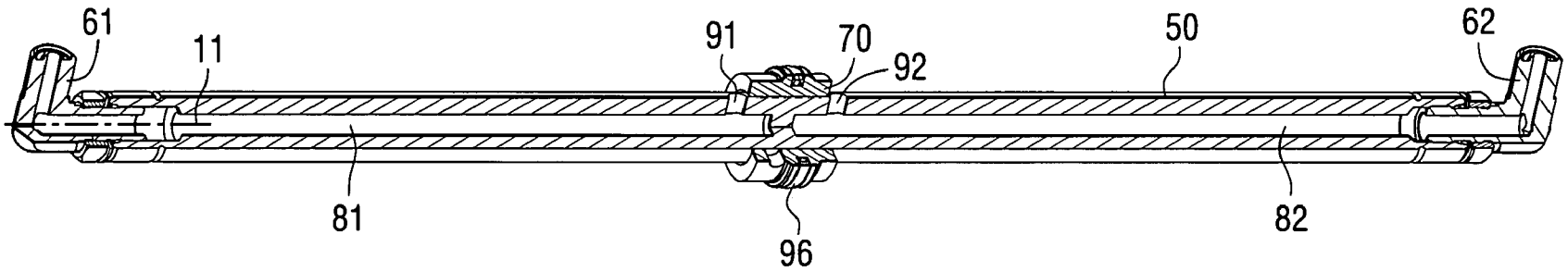
FIG. 8 is a sectioned isometric view of a piston rod used in a preferred embodiment of the present invention.

FIG. 8 is a sectioned isometric view of the piston rod 50 with a piston 70 attached to its center location. The piston 70 is provided with a seal member 96 which separates and defines the two portions, 71 and 72, of the internal cavity within the motive member 10 as described above in conjunction with FIGS. 6 and 7. It can be seen that the piston rod 50 performs at least two significant functions in relation to the present invention. It provides support for the sliding movement of the motive member 10 in a direction parallel to the first axis 11. In addition, it provides a conduit through which hydraulic fluid can be directed into or away from the two portions, 71 and 72, of the cavity within the motive member 10 as described above.

Figure 9:
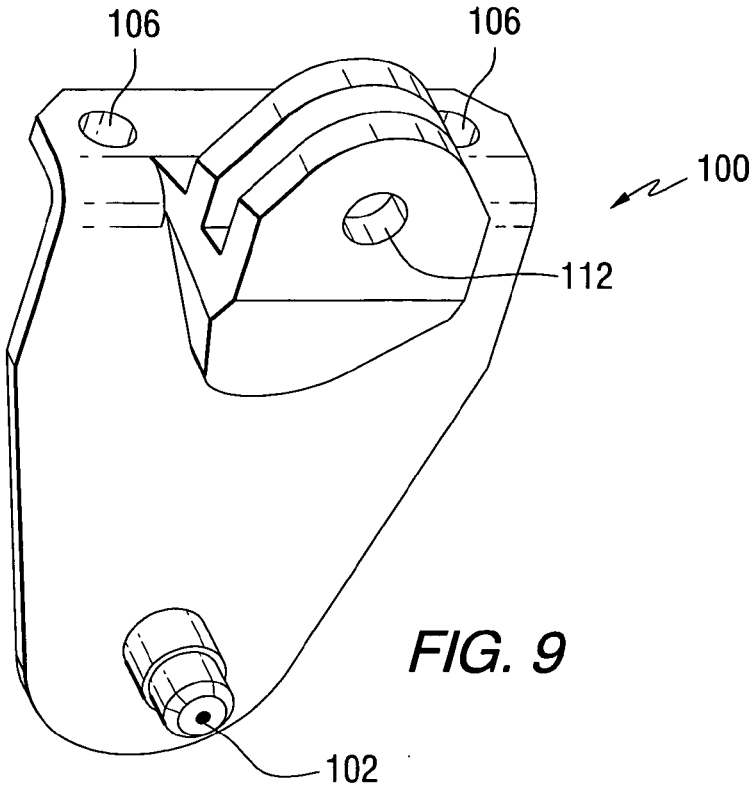
FIG. 9 shows a connecting link used in a preferred embodiment of the present invention.

FIG. 9 is an isometric representation of a connecting link 100 which can be used to rotatably attach the steering arm 40 to the actuator member 36. The connecting link 100 is provided with a protuberance 102 which is shaped to be received in an opening formed in the actuator member 36 at the connecting point 54, as described above in conjunction with FIGS. 1–4. Holes 106 allow the connecting link 100 to be attached to the distal end of the steering arm 40 which extends away from the steering axis 42. The clevis structure and hole 112 are not directly related to the present invention.

Figure 10:
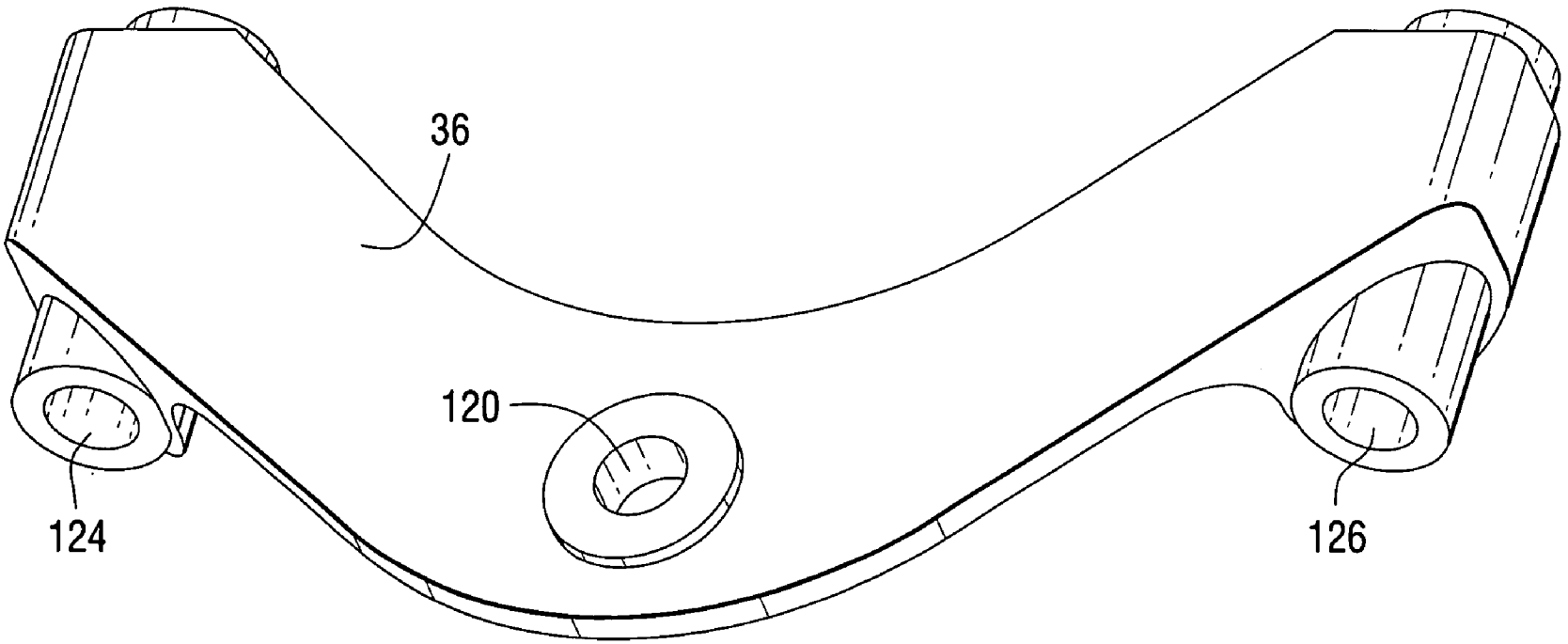
FIG. 10 shows an actuator member used in conjunction with a preferred embodiment of the present invention.

FIG. 10 is an isometric view of the actuator member 36. Opening 120 is shaped to receive a bolt that connects the actuator member 36 to the steering arm 40 at the position described as the connecting point 54 in FIGS. 1–5. Openings 124 and 126 are shaped to receive the rods, 21 and 22, in sliding association therein. This allows the actuator member 36 to slide toward and away from the motive member 10 when the motive member moves in a direction generally parallel to the first axis as described above in conjunction with FIGS. 1–5. The generally U-shaped form of the actuator member, in which opening 120 is farther from the motive member 10 than would be the case if the U-shaped bar was a straight bar, provides an advantage because it moves the connecting point 54, as described above, closer to the steering axis 42 than would otherwise be the case. This shortens the distance between the connecting point 54 and the steering axis 42 and, as a result, requires less linear travel by the motive member 10 in the direction parallel to the first axis 11. This reduced length of travel allows the overall structure to be smaller than would otherwise be possible.

Figure 11:
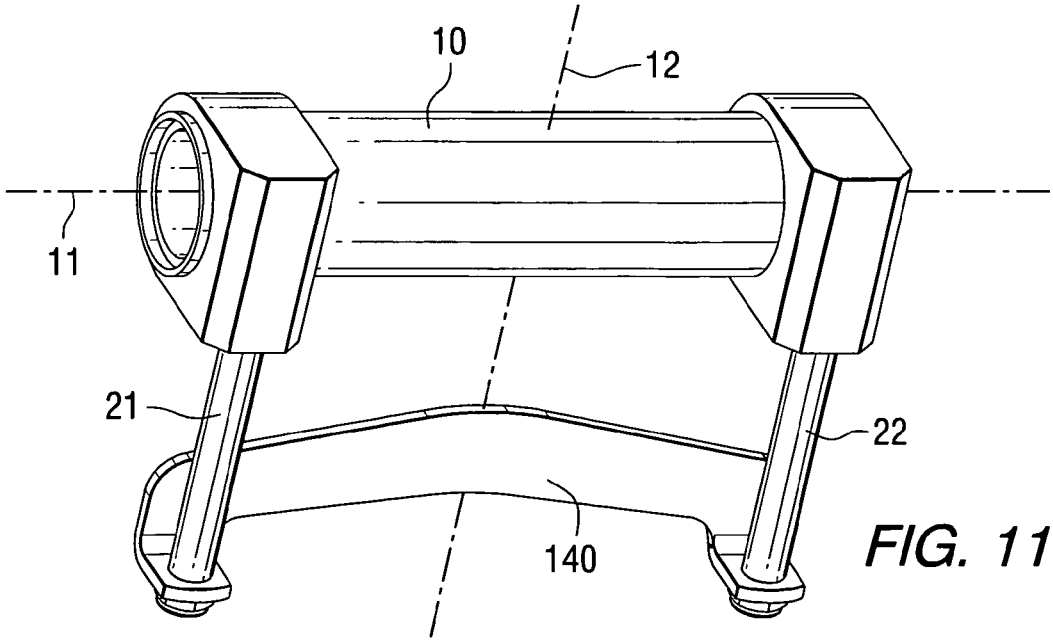
FIG. 11 shows the motive member, or hydraulic cylinder, with a brace member and the two rods of a guide rail.

FIG. 11 is an isometric representation of the motive member 10 and the first and second rods, 21 and 22. A bracing member 140 connects the distal ends of the rods, 21 and 22, for additional strength. The rods, 21 and 22, are generally parallel to the second axis 12 and generally perpendicular to the first axis 11. The length of the first and second rods, 21 and 22, are selected to allow sufficient travel of the actuator member 36 to accommodate the range of steering positions defined by the rotation of the steering arm 40 about the steering axis 42, as described above.

With reference to FIGS. 1–11, it can be seen that a preferred embodiment of the present invention comprises a motive member 10 which is movable along a first axis 11 and a guide rail structure which is attached to the motive member 10 and extends in a direction which is generally parallel to a second axis 12. An actuator member 36 is slidably attached to the guide rail structure for movement relative to the motive member 10 in a direction parallel to the second axis 12 and for movement with the motive member 10 parallel to the first axis 11. The actuator member 36 is attachable to a steering arm 40 of the marine propulsion system which is rotatable about a steering axis 42. A piston rod 50 has a central axis which is coaxial with a first axis 11. The motive member 10 is a hydraulic cylinder which is slidably associated with the piston rod 50. A piston 70 is attached to the piston rod 50 and disposed within the cylinder. The piston rod has a conduit, 81 and 82, formed therein to direct hydraulic fluid into the cavity, 71 and 72, of the hydraulic cylinder which is the motive member 10. A connecting link 100 is attached to the actuator member 36 and is attachable to the steering arm 40 of the marine propulsion system. The first axis 11 is defined by a stationary portion of the marine propulsion system which is attachable to a transom of a marine vessel. The steering arm 40 is attached to a rotatable portion of the marine propulsion system. The guide rail structure comprises two rods, 21 and 22, which extend in a direction which is generally perpendicular to the first axis 11 and generally parallel to the second axis 12. The two rods, 21 and 22, are shaped to be received in sliding association within two associated holes, 124 and 126, of the actuator member 36.

Although the present invention has been described in particular detail and illustrated to show a preferred embodiment, it should be understood that alternative embodiments are also within its scope.

The invention claimed is:

1. A steering actuation system of a marine propulsion system, comprising:

a motive member configured to steer the marine propulsion system and which is movable along a first axis;

a guide rail structure attached to said motive member and extending from said motive member in a direction which is generally parallel to a second axis; and an actuator member slidably attached to said guide rail structure for movement relative to said motive member in a direction parallel to said second axis and movement with said motive member parallel to said first axis, said actuator member being attachable to a steering arm of said marine propulsion system which is rotatable about a steering axis.

2. The steering actuation system of claim 1, further comprising:

a piston rod having a central axis which is coaxial with said first axis, said motive member being a cylinder which is slidably associated with said piston rod;

a piston attached to said piston rod and disposed within said cylinder.

3. The steering actuation system of claim 2, wherein:

said cylinder is a hydraulic cylinder, said piston rod having a conduit formed therein to direct hydraulic fluid into a cavity of said hydraulic cylinder.

4. The steering actuation system of claim 1, further comprising:

a connecting link attached to said actuator member.

5. The steering actuation system of claim 4, wherein:

said connecting link is attachable to said steering arm of said marine propulsion system.

6. The steering actuation system of claim 1, wherein:

said first axis is defined by a stationary portion of said marine propulsion system which is attachable to a marine vessel.

7. The steering actuation system of claim 1, wherein:

said steering arm is attached to a rotatable portion of said marine propulsion system.

8. The steering actuation system of claim 1, wherein:

said guide rail structure comprises two rods, said two rods extending in a direction which is generally perpendicular to said first axis and generally parallel to said second axis.

9. The steering actuation system of claim 8, wherein:

said two rods are shaped to be received in sliding association within two associated holes formed in said actuator member.

10. The steering actuation system of claim 1, wherein:

said guide rail structure comprises a rod, said rod being shaped to be received in sliding association within a hole formed in said actuator member.

11. A steering actuation system of a marine propulsion system, comprising:

a motive member configured to steer the marine propulsion system and which is movable along a first axis;

a guide rail structure attached to said motive member and extending from said motive member in a direction which is generally parallel to a second axis;

an actuator member slidably attached to said guide rail structure for movement relative to said motive member in a direction parallel to said second axis and movement with said motive member parallel to said first axis, said actuator member being attachable to a steering arm of said marine propulsion system which is rotatable about a steering axis;

a piston rod having a central axis which is coaxial with said first axis, said motive member comprising a hydraulic cylinder which is slidably associated with said piston rod; and a piston attached to said piston rod and disposed within said hydraulic cylinder.

12. The steering actuation system of claim 11, wherein:

said piston rod has a conduit formed therein to direct hydraulic fluid into a cavity of said hydraulic cylinder.

13. The steering actuation system of claim 11, further comprising:

a connecting link attached to said actuator member, said connecting link being attachable to said steering arm of said marine propulsion system.

14. The steering actuation system of claim 11, wherein:

said first axis is defined by a stationary portion of said marine propulsion system which is attachable to a marine vessel, said steering arm being attached to a rotatable portion of said marine propulsion system.

15. The steering actuation system of claim 11, wherein:

said guide rail structure comprises two rods, said two rods extending in a direction which is generally perpendicular to said first axis and generally parallel to said second axis, said two rods being shaped to be received in sliding association within two associated holes formed in said actuator member.

16. A steering actuation system of a marine propulsion system, comprising:

a motive member configured to steer the marine propulsion system and which is movable along a first axis, the position of said first axis is defined by a stationary portion of said marine propulsion system;

a guide rail structure attached to said motive member and extending from said motive member in a direction which is generally parallel to a second axis, said guide rail structure comprising two rods, said two rods extending in a direction which is generally perpendicular to said first axis and generally parallel to said second axis; and an actuator member slidably attached to said guide rail structure for movement relative to said motive member in a direction parallel to said second axis and movement with said motive member parallel to said first axis, said actuator member being attachable to a steering arm of said marine propulsion system which is rotatable about a steering axis;

a connecting link attached to said actuator member, said connecting link being attachable to said steering arm of said marine propulsion system.

17. The steering actuation system of claim 16, further comprising:

a piston rod having a central axis which is coaxial with said first axis, said motive member being a cylinder which is slidably associated with said piston rod;

a piston attached to said piston rod and disposed within said cylinder, said cylinder being a hydraulic cylinder, said piston rod having a conduit formed therein to direct hydraulic fluid into a cavity of said hydraulic cylinder.

18. The steering actuation system of claim 17, wherein:

said steering arm is attached to a rotatable portion of said marine propulsion system.

19. The steering actuation system of claim 17, wherein:

said two rods are shaped to be received in sliding association within two associated holes formed in said actuator member.

20. The steering actuation system of claim 17, wherein:

said piston rod having two hydraulic fluid inlets formed therein for alternately supplying hydraulic fluid to two portions of said conduit which are located on opposite sides of said piston.

* * * * *